US010064433B2

(12) United States Patent
Li et al.

(10) Patent No.: US 10,064,433 B2
(45) Date of Patent: Sep. 4, 2018

(54) ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Hongxing Duan, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 218 days.

(21) Appl. No.: 15/064,597

(22) Filed: Mar. 8, 2016

(65) Prior Publication Data

US 2016/0183597 A1 Jun. 30, 2016

(30) Foreign Application Priority Data

Apr. 29, 2015 (CN) ..... 2015 2 0268222 U

(51) Int. Cl.

| | |
|---|---|
| ***A61H 33/12*** | (2006.01) |
| ***A24F 47/00*** | (2006.01) |
| ***H05B 1/02*** | (2006.01) |
| ***H05B 3/00*** | (2006.01) |

(52) U.S. Cl.

CPC ..... *A24F 47/008* (2013.01); *H05B 1/0244* (2013.01); *H05B 3/0014* (2013.01)

(58) Field of Classification Search

None

See application file for complete search history.

(56) References Cited

U.S. PATENT DOCUMENTS

| | | | | |
|---|---|---|---|---|
| 3,938,947 | A * | 2/1976 | Rosenthal | F17C 13/04 251/121 |
| 9,254,007 | B2 * | 2/2016 | Liu | A24F 47/008 |
| 9,622,511 | B2 * | 4/2017 | Zhu | A24F 47/008 |
| 2012/0111347 | A1 * | 5/2012 | Hon | A24F 47/008 131/329 |
| 2013/0180533 | A1 * | 7/2013 | Kim | A24F 47/008 131/273 |
| 2013/0228191 | A1 * | 9/2013 | Newton | A24F 47/008 131/329 |

(Continued)

*Primary Examiner* — Thor Campbell

(74) *Attorney, Agent, or Firm* — Cheng-Ju Chiang

(57) ABSTRACT

An exemplary atomizer includes an atomizing assembly and a liquid supply. The liquid supply includes a connection end. The atomizing assembly is detachably connected to the connection end. The connection end defines at least one liquid outlet, through which the tobacco liquid flows into the atomizing assembly. The atomizing assembly further includes a sealing element and an elastic element. The sealing element is configured for sealing the liquid outlet when in a first position, and the elastic element abuts against the sealing element. When the atomizing assembly is connected with the liquid supply, the atomizing assembly is configured for driving the sealing element to move to a second position where the liquid outlet is opened. When the atomizing assembly is detached from the liquid supply, the atomizing assembly is configured for driving the sealing element to return to the first position where the sealing element seals the liquid outlet.

11 Claims, 5 Drawing Sheets

(56) References Cited

U.S. PATENT DOCUMENTS

| | | | | |
|---|---|---|---|---|
| 2014/0060524 | A1* | 3/2014 | Liu | A24F 47/008 128/200.14 |
| 2014/0299139 | A1* | 10/2014 | Liu | A24F 47/008 131/329 |
| 2014/0360514 | A1* | 12/2014 | Zhu | A24F 47/008 131/329 |
| 2015/0181939 | A1* | 7/2015 | Liu | A24F 47/008 131/329 |
| 2015/0313288 | A1* | 11/2015 | Liu | A24F 47/008 131/329 |
| 2016/0007654 | A1* | 1/2016 | Zhu | A24F 47/008 131/328 |
| 2016/0044963 | A1* | 2/2016 | Saleem | A24F 47/008 131/328 |
| 2016/0332754 | A1* | 11/2016 | Brown | B65B 3/10 |

* cited by examiner

ATOMIZER AND ELECTRONIC CIGARETTE HAVING SAME

TECHNICAL FIELD

The present invention relates to electronic cigarettes, and particularly to an atomizer and an electronic cigarette using same.

BACKGROUND ART

A typical atomizer includes an atomizing assembly and a liquid supply. The liquid supply is configured for storing tobacco liquid. The atomizing assembly is adapted for generating aerosol from the tobacco liquid. In a non-use state, the tobacco liquid may leak during transportation and storage.

What is needed, therefore, is an atomizer and an electronic cigarette using same, which can overcome the above shortcomings.

SUMMARY

An exemplary atomizer includes an atomizing assembly and a liquid supply. The liquid supply includes a connection end. The atomizing assembly is detachably connected to the connection end. The connection end defines at least one liquid outlet, through which the tobacco liquid flows into the atomizing assembly. The atomizing assembly further includes a sealing element and an elastic element. The sealing element is configured for sealing the liquid outlet when in a first position, and the elastic element abuts against the sealing element. When the atomizing assembly is connected with the liquid supply, the atomizing assembly is configured for driving the sealing element to move to a second position where the liquid outlet is opened. When the atomizing assembly is detached from the liquid supply, the atomizing assembly is configured for driving the sealing element to return to the first position where the sealing element seals the liquid outlet.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
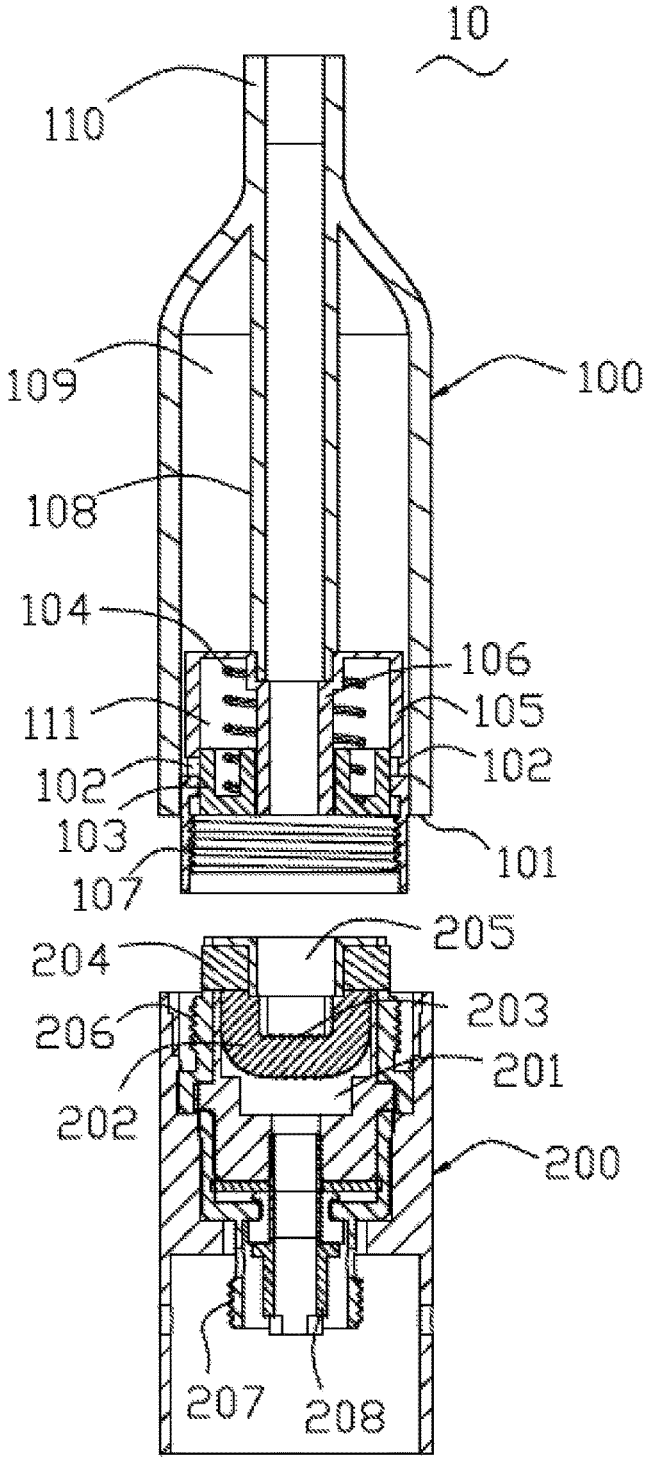
FIG. 1 is a cross-sectional view of an atomizer according to a first embodiment, including a liquid supply and an atomizing assembly separated from each other, the liquid supply including a sealing element.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Referring to FIG. 1, an atomizer 10 includes an atomizing assembly 200 and a liquid supply 100 for storing tobacco liquid. The atomizer 10 is configured for generating aerosol from the tobacco liquid. The liquid supply 100 includes a connection end 101, and the atomizing assembly 200 is detachably coupled with the connection end 101. The liquid supply 100 defines a liquid chamber 109 for receiving the tobacco liquid. In a non-use state (e.g., during transportation), the liquid supply 100 and the atomizing assembly 200 are separated from each other, and the tobacco liquid is sealed in the liquid chamber 109 by a sealing mechanism (described in detail later). When the liquid supply 100 and the atomizing assembly 200 are connected, the tobacco liquid in the liquid chamber 109 flows into the atomizing assembly 200. In the present embodiment, the liquid supply 100 and the atomizing assembly 200 are coupled threadedly. The liquid supply 100 includes a plurality of internal threads 107 in the connection end 101, and a plurality of external threads 206 at one end of the atomizing assembly 200.

A structure of the sealing mechanism will be described in detail below. The connection end 101 includes at least one liquid outlet 102, through which the tobacco liquid in the liquid supply 100 flows into the atomizing assembly 200. The total quantity of the liquid outlets 102 may be adjusted by an amount of the aerosol needed. The atomizer 10 further includes a sealing element 103 and an elastic element 104 at the connection end. The sealing element 103 is configured (i.e., structured and arranged) for sealing the liquid outlet 102. The elastic element 104 abuts against the sealing element 103. The sealing element 103 is capable of moving up and down along an axis of the atomizer 10 relative to a housing of the liquid supply 100. In an inactive state, the sealing element 103 is kept in a suitable position (i.e., a first position) by the elastic element 104 where the sealing element 103 seals the liquid outlet 102. When the atomizer 200 is connected to the liquid supply 100, the atomizer 200 forces the sealing element 103 to move to a second position where the liquid outlet 102 is opened. In this state, the tobacco liquid flows into the atomizing assembly 200. When the atomizing assembly 200 is detached from the liquid supply 100, the elastic element 104 drives the sealing element 103 to return to the first position where the sealing element 103 seals the liquid outlet 102. It is to be understood that when the atomizing assembly 200 is detached from the liquid supply 100, the sealing mechanism at the connection end 101 may be detached, so that tobacco liquid can be filled in the liquid chamber 109.

In detail, a supporting holder 105 is fixed in the connection end 101, and the sealing element 103 and the elastic element 104 are both arranged in the supporting holder 105. The liquid outlet 102 is defined in a sidewall of the supporting holder 105. When the sealing element 103 moves along an axial direction of the supporting holder 105, the sealing element 103 opens or closes the liquid outlet 102. The supporting holder 105 and the housing of the liquid supply 100 are both cylindrical. A tiny gap is cooperatively defined between an outer sidewall of the supporting holder 105 and an inner wall of the housing of the liquid supply 100. The liquid outlet 102 is in communication with the gap, so that the tobacco liquid in the liquid chamber 109 can flow out slowly via the liquid outlet 102. Quite usefully, the supporting holder 105 defines a plurality of liquid outlets 102, which are evenly arranged a circumferential direction. In this way, the tobacco liquid in the liquid chamber 109 can flow out more evenly.

Figure 4:
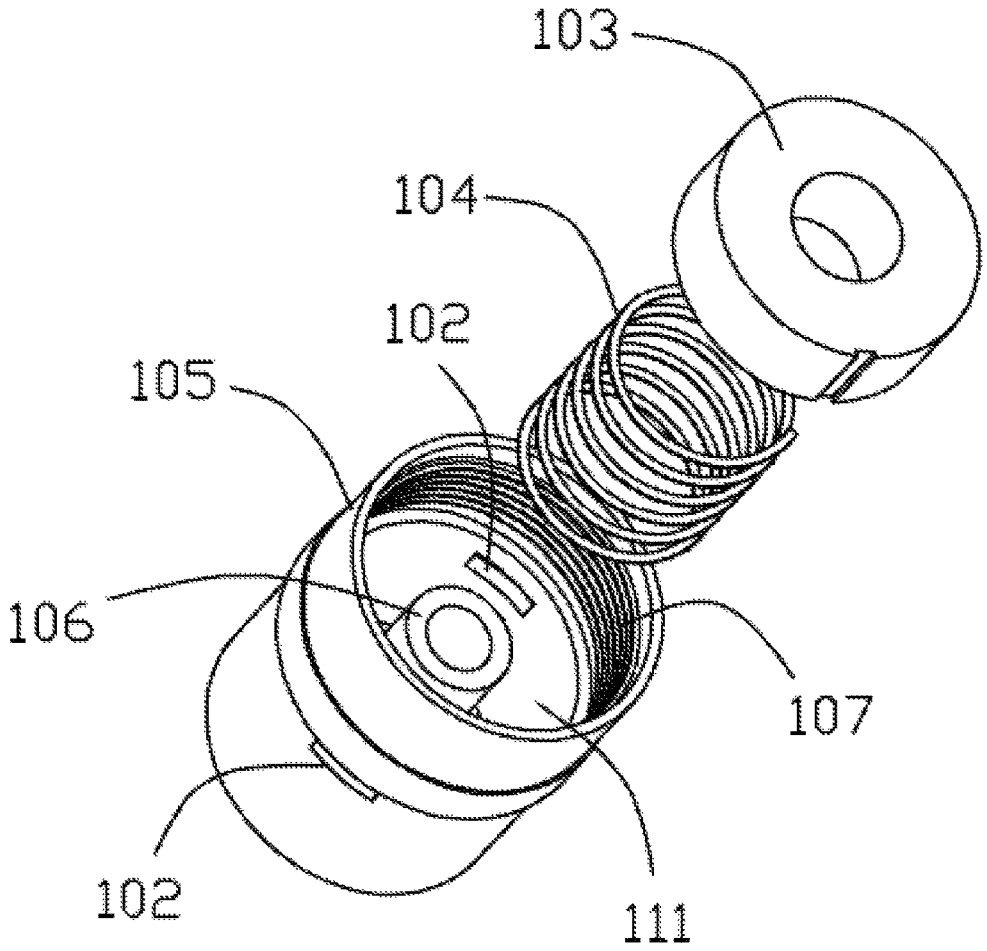
FIG. 4 is an exploded perspective view, showing a supporting holder, an elastic element, and a supporting holder of FIG. 1.

Referring to FIGS. 1 and 4, the supporting holder 105 defines an annular groove 111, and the sealing element 103 and the elastic element 104 are both arranged in the annular groove 111. The sealing element 103 is capable of moving along an axis of the annular groove 111. In the present embodiment, the elastic element 104 is a spring, and the sealing element 103 is a silicone stopper. The sealing element 103 is annular, and one end of the spring abuts against the silicone stopper. The supporting holder 105 includes a tubular part 106 coaxial with a housing of the supporting holder 105. The supporting holder 105 includes a plurality of internal screws 107 formed on an interior wall. The tubular part 106 and the interior wall of the supporting holder 105 cooperatively define the above annular groove 111. The tubular part 106 is hollow, so that the aerosol can pass through the tubular part 106. The spring and the silicone stopper nest the tubular part 106, and the tubular part 106 guides the silicone stopper to move up and down.

The liquid supply 100 includes an air pipe 108 inside. The air pipe 108 and the liquid supply 100 are integrally formed. The air pipe 108 and the housing of the liquid supply 100 cooperatively define an annular space serving as the above liquid chamber 109. An upper end of the air pipe 108 is connected with a mouthpiece 110, and a lower end of the air pipe 108 is hermetically connected to the tubular part 106. The air pipe 108 is configured for conveying the aerosol to the mouthpiece 110 for inhalation.

Quite usefully, the atomizing assembly 200 includes an atomizing chamber 201, a liquid conducting body 202 in the atomizing chamber 201, and a heating element 203 in the atomizing chamber 201. The heating element 203 is in contact with the liquid conducting body 202. The heating element 203 is configured for heating the tobacco liquid to form aerosol. The atomizing chamber 201 includes an air inlet at a bottom part, and an aerosol outlet 205 at a top part. When the liquid supply 100 is connected with the atomizing assembly 200, a bottom end of the tubular part 106 is inserted in the aerosol outlet 205, and is hermetically connected with the aerosol outlet 205. The aerosol generated in the atomizing chamber 201 goes in the tubular part 106 and the air pipe 108 via the aerosol outlet 205. The liquid conducting body 202 may be made of glass fiber material, porous ceramic, and so on. In the present embodiment, the liquid conducting body 202 is made of glass fiber material, and the heating element 203 includes a heating wire wound around the liquid conducting body 202. The atomizing device 200 includes a first electrode 207 and a second electrode 208, and two ends of the heating wire are connected to the first and the second electrodes 207, 208 respectively. The first and the second electrodes 207, 208 are respectively connected with two electrodes of an external power supply. The first electrode 207 includes a plurality of screw threads, facilitating an electrical and mechanical connection between the atomizing assembly 200 and the power supply.

Quite usefully, to control a flowing speed of the tobacco liquid into the atomizing chamber 201, a liquid absorbing layer 204 is further arranged between the atomizing chamber 201 and the liquid outlet 102. The liquid absorbing layer 204 is made of fiber cotton, and two ends of the liquid conducting body 202 are in contact with the liquid absorbing layer 204. The liquid absorbing layer 204 is configured for absorbing tobacco liquid flowing out from the liquid outlet 102, preventing too much tobacco liquid from directly flowing in the atomizing chamber 201.

Figure 2:
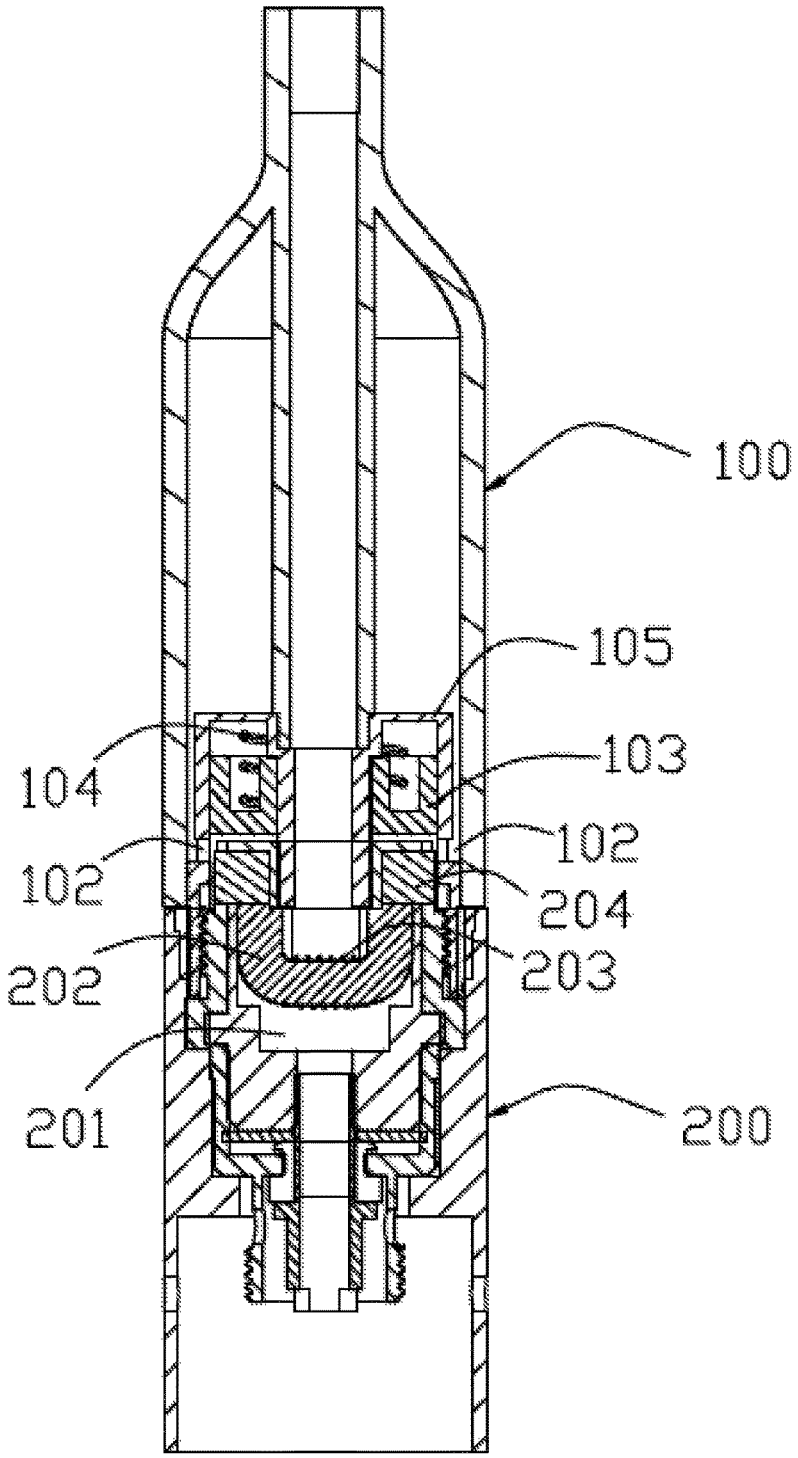
FIG. 2 is an assembled cross-sectional view of the atomizer of FIG. 1.
Figure 3:
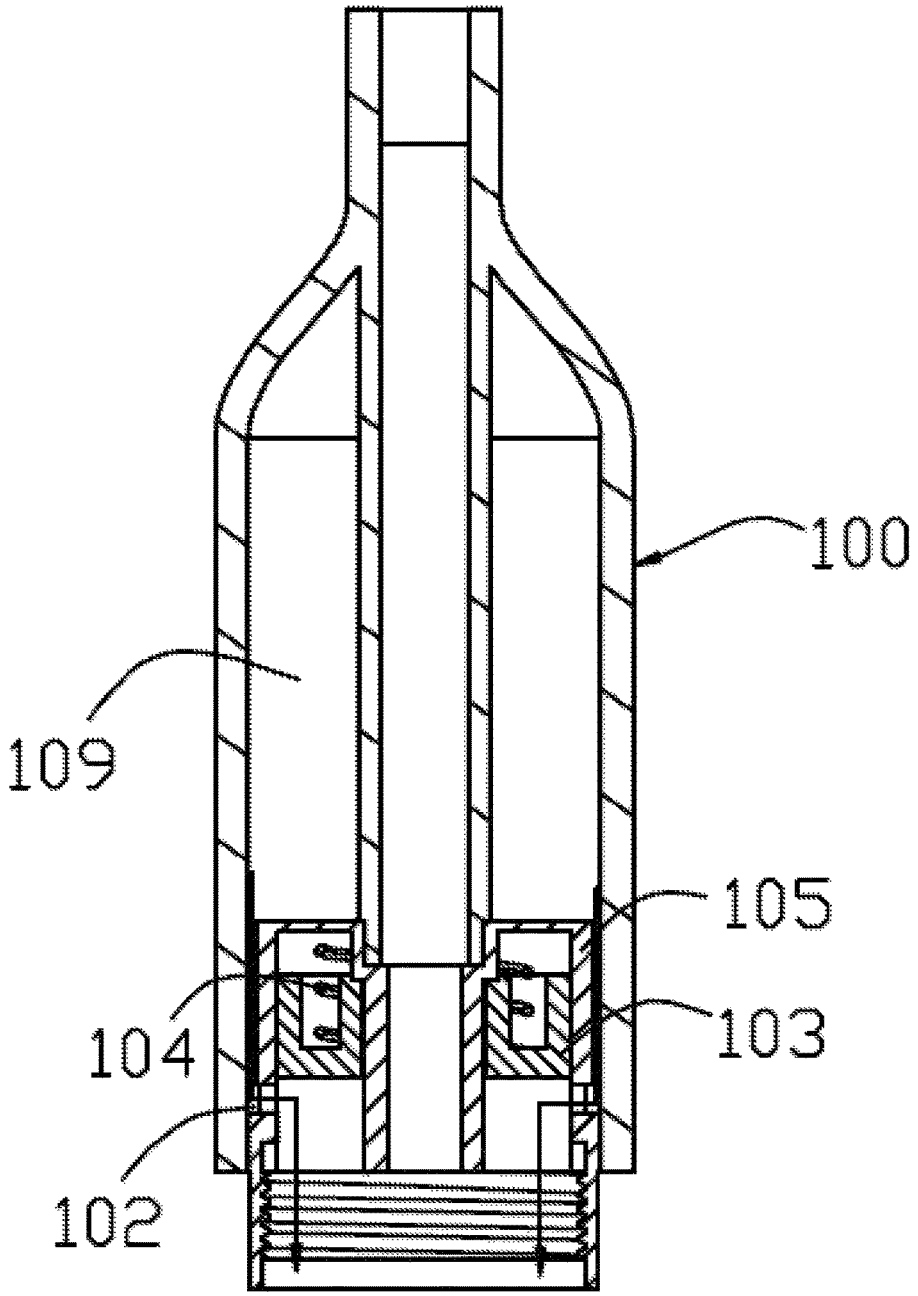
FIG. 3 is a cross-sectional view of the liquid supply, showing a state when the sealing element is lifted to expose a liquid outlet.

Referring to FIGS. 2-3, when the atomizing assembly 200 is screwed in the connection end 101 of the liquid supply 100, an upper end of the atomizing assembly 200 pushes the sealing element 103 to move upwards, and the liquid outlet 102 in the supporting holder 105 is exposed. In this first position, the elastic element 104 is compressed, and the elastic element 104 drives a lower end of the sealing element 103 to tightly abut against an upper end of the atomizing assembly 200. Due to flexibility of the sealing element 103, the lower end of the sealing element 103 is hermetically coupled with the upper end of the atomizing assembly 200, preventing the tobacco liquid from directly flowing into the atomizing chamber 201 via the aerosol outlet 205. After the sealing element 103 is pushed up, the tobacco liquid flows out from the liquid outlet 102 to the liquid absorbing layer 204. The tobacco liquid is then conveyed to the heating element 203 by the liquid conducting body 202.

Figure 5:
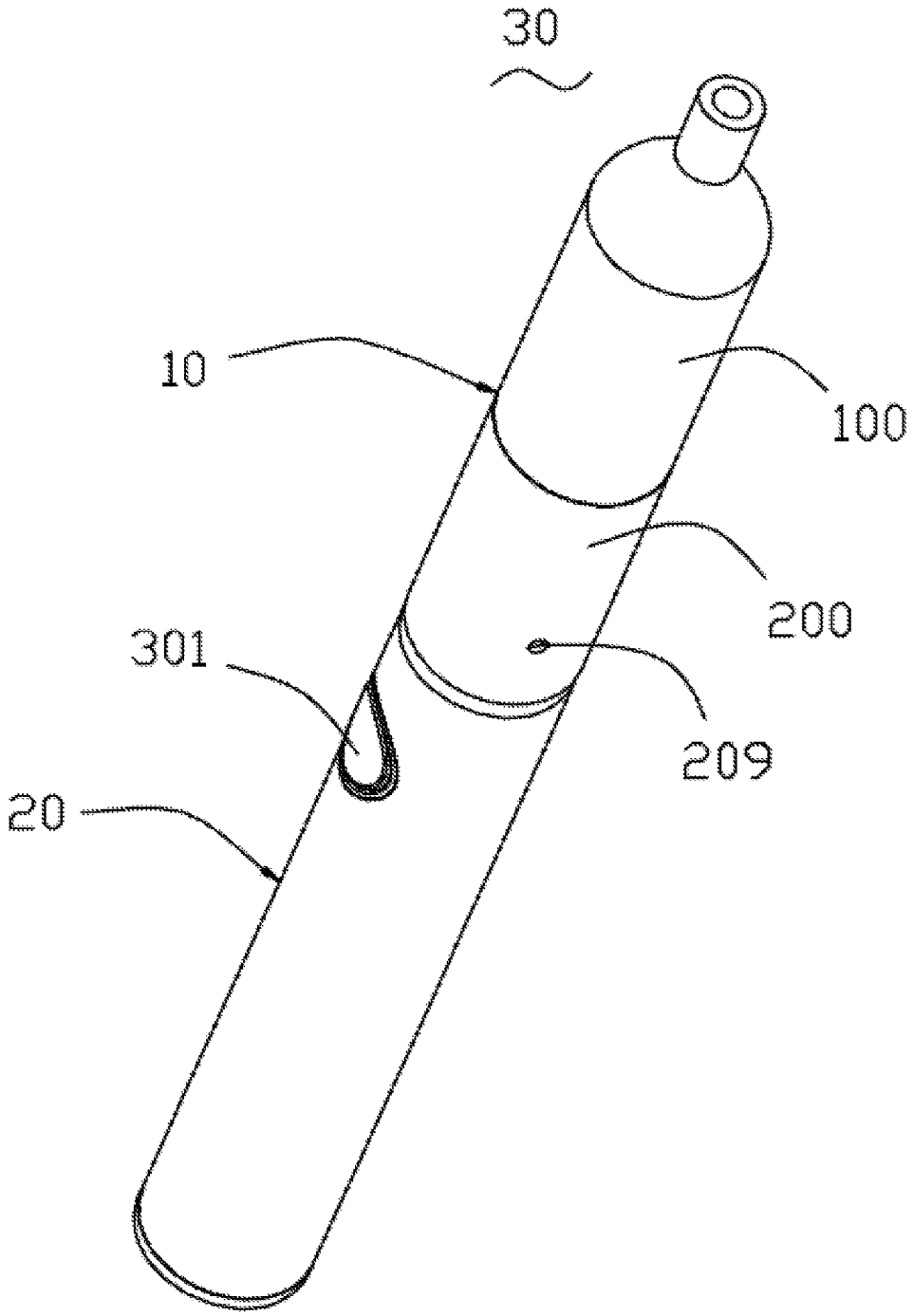
FIG. 5 is a cross-sectional view of an electronic cigarette according to a second embodiment.

Referring to FIG. 5, an electronic cigarette 30 includes the above mentioned atomizer 10, and a power supply 20 connected with the atomizer 10. The atomizer assembly 200 defines an air inlet 209 in an exterior wall. The power supply 20 is cylindrical, and includes a battery and a smoking button 301. When the smoking button 301 is pressed, the atomizer 10 is powered on to form aerosol.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer, comprising an atomizing assembly and a liquid supply configured for storing tobacco liquid, the liquid supply comprising a connection end, the atomizing assembly being detachably connected to the connection end, wherein the connection end defines at least one liquid outlet, through which the tobacco liquid in the liquid supply flows into the atomizing assembly, the at least one liquid outlet formed at a sidewall in the connection end, the atomizer further comprises a sealing element and an elastic element disposed in the connection end, the sealing element is configured for sealing the liquid outlet to block flowing of the tobacco liquid into the atomizing assembly when the sealing element is moved in a first position thereof, and the elastic element abuts against the sealing element to keep the sealing element stay in the first position thereof; when the atomizing assembly is connected with the liquid supply, the atomizing assembly is configured for driving the sealing element to move to a second position thereof where the liquid outlet is opened; when the atomizing assembly is detached from the liquid supply, the elastic element is configured for driving the sealing element to return to the first position where the sealing element seals the liquid outlet after detachment of the atomizing assembly in order to avoid leaking of the tobacco liquid out of the liquid supply.

2. The atomizer in accordance with claim 1, further comprising a supporting holder in the connection end, wherein the sealing element and the elastic element are arranged in the supporting holder, the at least one liquid outlet is defined in a sidewall of the supporting holder, and the sealing element is capable of moving along an axis of the supporting holder to open or close the liquid outlet.

3. The atomizer in accordance with claim 2, wherein the supporting holder comprises an annular groove extending along the axis, the sealing element and the elastic element are both received in the annular groove, and the sealing element is capable of moving along an axis of the annular groove.

4. The atomizer in accordance with claim 3, wherein the elastic element comprises a spring, the sealing element comprises a silicone stopper, the silicone stopper is annular, and an end of the spring abuts against the silicone stopper.

5. The atomizer in accordance with claim 4, wherein the supporting holder comprises a tubular part, and the spring and the silicone stopper nest the tubular part.

6. The atomizer in accordance with claim 5, wherein the liquid supply comprises an air pipe inside, and the air pipe is hermetically coupled with the tubular part.

7. The atomizer in accordance with claim 2, wherein the at least one liquid outlet comprises a plurality of liquid outlets, and the liquid outlets are evenly arranged in the sidewall of the supporting holder along a circumferential direction.

8. The atomizer in accordance with claim 1, wherein the atomizing assembly comprises an atomizing chamber, a liquid conducting body in the atomizing chamber, and a heating element in the atomizing chamber, the heating element contacts with the liquid conducting body, and the heating element is configured for heating the tobacco liquid to form aerosol.

9. The atomizer in accordance with claim 8, further comprising a liquid absorbing layer between the atomizing chamber and the liquid outlet, wherein two opposite ends of the liquid conducting body is in contact with the liquid absorbing layer.

10. An electronic cigarette, comprising:

an atomizer according to claim 1; and a power supply connected with the atomizer, the power supply being configured for feeding the atomizer power.

11. An atomizer, comprising an atomizing assembly and a liquid supply configured for storing tobacco liquid, the liquid supply comprising a connection end, the atomizing assembly being detachably connected to the connection end, wherein the connection end defines at least one liquid outlet, through which the tobacco liquid in the liquid supply flows into the atomizing assembly, the atomizer further comprises a sealing element and an elastic element, the sealing element is configured for sealing the liquid outlet when in a first position, and the elastic element abuts against the sealing element; when the atomizing assembly is connected with the liquid supply, the atomizing assembly is configured for driving the sealing element to move to a second position where the liquid outlet is opened; when the atomizing assembly is detached from the liquid supply, the elastic element is configured for driving the sealing element to return to the first position where the sealing element seals the liquid outlet; wherein the elastic element comprises a spring, the sealing element comprises a silicone stopper, the silicone stopper is annular, and an end of the spring abuts against the silicone stopper.

* * * * *